US005922172A

United States Patent [19]

Pettersson et al.

[11] Patent Number: 5,922,172

[45] Date of Patent: Jul. 13, 1999

[54] COMBUSTION OF BLACK LIQUID AND PROCESSING OF LIME SLUDGE IN A RECOVERY BOILER

[75] Inventors: Bertil Pettersson; Bertil Granqvist; Ingemar Eriksson, all of Gävle, Sweden

[73] Assignee: Korsnas AB, Gavle, Sweden

[21] Appl. No.: 08/966,558

[22] Filed: Nov. 10, 1997

Related U.S. Application Data

[63] Continuation of application No. 08/549,769, Dec. 1, 1995., abandoned, filed as application No. PCT/SE94/00536, Jun. 3, 1994.

[30] Foreign Application Priority Data

Jun. 4, 1993 [SE] Sweden ..... 01920

[51] Int. Cl.[6] ..... D21C 11/12

[52] U.S. Cl. ..... 162/30.1; 162/30.11

[58] Field of Search ..... 162/30.1, 30.11, 162/31; 110/238; 423/206, 207, DIG. 3

[56] References Cited

U.S. PATENT DOCUMENTS

| | | | |
|---|---|---|---|
| 1,560,900 | 4/1925 | Drewsen . | |
| 1,743,080 | 1/1930 | Bradley et al. . | |
| 3,366,535 | 1/1968 | Cann | 162/30 |
| 4,322,266 | 3/1982 | Nelson | 162/30 |
| 4,507,172 | 3/1985 | Steltenkamp | 162/30.11 |

FOREIGN PATENT DOCUMENTS

| | | |
|---|---|---|
| 2 550 245 | 2/1985 | France . |
| 8321501 | 2/1983 | Japan . |

OTHER PUBLICATIONS

J. N. Stephenson, "Preparation & Treatment of Wood Pulp", vol. 1., p. 423, Aug. 1950.

Chemical Abstracts, vol. 69, 1968, pp. 1112–1113, item No. 11540.

*Primary Examiner*—Stanley S. Silverman
*Assistant Examiner*—Dean T. Nguyen
*Attorney, Agent, or Firm*—Bacon & Thomas, PLLC

[57] ABSTRACT

A method of modifying the course of combustion when evaporated black liquor is burnt in the furnace cavity of a recovery boiler is described. The method implies that lime sludge is supplied to the furnace cavity whereby the course of combustion is modified so that the temperature in the furnace cavity is raised. Also use of a recovery boiler for simultaneous combustion of black liquor and processing of lime sludge is described. In one embodiment of this use is disclosed that the processing of lime sludge is performed so that increased formation of calcium sulphide in the smelt of inorganic chemicals, which is formed in the recovery boiler, is obtained and/or so that the lime sludge is calcined.

7 Claims, No Drawings

COMBUSTION OF BLACK LIQUID AND PROCESSING OF LIME SLUDGE IN A RECOVERY BOILER

This application is a Continuation of application Ser. No. 08/549,769, filed Dec. 1, 1995, now abandoned, which is a 371 of PCT/SE94/00536, filed Jun. 3, 1994.

The present invention relates to a method of modifying the course of combustion when evaporated black liquor is burnt. More precisely, the method involves supplying of lime sludge to the furnace cavity in such an amount that the course of combustion is modified. Further, the invention relates to the use of a recovering boiler for simultaneous combustion of black liquor and processing of lime sludge. The processing of lime sludge implies a calcination of the lime sludge and/or an increase in the formation of calcium sulphide in the smelt of inorganic chemicals which is formed in the recovering boiler.

BACKGROUND

In the production of woodpulp in accordance with the sulphate process, the wood is treated in the form of wood chips in an alkaline solution, which mainly consists of NaOH and NaHS, in a cooking process at a temperature which in the final stage lies in the range of 150–175° C.

Upon separation of the cellulose fibres which have been detached in the cooking process, a solution of a recycled liquor is obtained, which is also called black liquor, and which in addition to the inorganic chemicals charged in the cooking process also contains from the wood released organic substanses, which mainly consist of lignin.

Thereafter, the black liquor is evaporated to a dry solids content which makes it possible to burn the organic contents without the need of supplying supplementary auxiliary fuel to the combustion plant.

After evaporation of the black liquor, it is transported to a liquor combustion plant, which normally is a so called recovery boiler, but can also be a liquor gasification plant.

In a recovery boiler the burning of the black liquor is mainly effected in the furnace cavity which comprises an upper oxidation zone and a lower reduction zone, the temperature being higher in the oxidation zone than in the reduction zone.

In the combustion of the organic part of the black liquor the chemical energy is taken care of by the transformation to heat energy and electrical energy, and the inorganic chemicals are recovered. Normally, the sulphur content is converted to an active form for the cooking process, i.e. to sulphide. The portion of sodium which is not bound to the sulphur exists mainly in the form of carbonate.

The inorganic chemicals leave the combustion process mainly in melted form (e.g. at 750–850° C.) and are further processed for recovery of the chemicals.

In such a further processing there is i.a. formed sparingly soluble $CaCO_3$, which is called lime sludge. Said lime sludge is washed with water prior to reburning in a rotary kiln, whereby a weakly alkaline solution (weak liquor) is obtained. The reburning of the lime sludge, i.e. the conversion of $CaCO_3$ into CaO, is energy-consuming and puts high demands on the quality of the fuel, so that a high flashing point can be maintained in the calcination zone of the rotary kiln. Normally approximately 40–45% of the effective heat of the fuel is consumed by the calcination reaction, 15–20% of the consumed fuel being lost by heat radiation from the mantle surface of the kiln and the lime cooler.

In experiments aiming at an improvement of the utilization of a recovery boiler it has now surprisingly been found that the recovery boiler may be used for simultaneous combustion of the black liquor and the processing of lime sludge. Most surprising is however that the course of combustion is modified in the furnace cavity when black liquor is burnt in the presence of lime sludge, so that the temperature in said furnace cavity is raised even though the conversion of $CaCO_3$ to CaO is endothermic.

DESCRIPTION OF THE INVENTION

One aspect of the invention is directed to the use of a recovery boiler for simultaneous burning of black liquor and processing of lime sludge.

One embodiment of this aspect of the invention implies that the processing of the lime sludge is calcination of lime sludge and/or the processing of lime sludge is conducted so that increased formation of calcium sulphide in the smelt of inorganic chemicals, which is formed in the recovery boiler, is obtained.

The utilization of such calcium sulphide rich smelt of inorganic chemicals for the production of white liquor with enhanced and/or reduced sulphidity has been disclosed in the simultaneously filed patent application having the title "Preparation of white liquor".

Another aspect of the invention is directed to a method of modifying the course of combustion when evaporated black liquor is burnt in the furnace cavity of a recovery boiler by supplying lime sludge to the furnace cavity, whereby the course of combustion is modified so that the temperature in the furnace cavity is raised, and at the same time the supplied lime sludge is processed.

In one embodiment of the invention the type of processing of the supplied lime sludge is controlled by regulation of the temperature in the furnace cavity. The temperature may then be regulated so that the lime sludge will be at least partially calcined. Moreover, the temperature may be regulated so that the lime sludge will give increased formation of calcium sulphide in the smelt of inorganic chemicals which has been formed in the recovery boiler.

In a preferred embodiment of the invention the black liquor and the lime sludge are mixed before they are supplied to the furnace cavity.

The amount of lime sludge which is to be supplied in order to modify the course of combustion depends on several process parameters which may vary between different recovery boilers. However, a man of ordinary skill in the art may easily adapt the amount of lime sludge that is required to modify the course of combustion in the furnace cavity of a recovery boiler when the present invention is used, with the guidance of the present description of the invention.

The temperature in the furnace cavity may be controlled so that lime sludge will be at least partially calcined and/or so that lime sludge gives increased formation of calcium sulphide in the smelt of inorganic chemicals which is formed in the combustion plant. The determining factor is whether the temperature in the furnace cavity reaches calcination temperature for lime sludge, or whether the temperature is kept therebelow. In the formula below, which describe the reaction with lime sludge ($CaCO_3$) in the combustion of black liquor, the calcination temperature has been set at 800° C., but it can vary considerably e.g. by ±70° C.

1. $CaCO_3 + Na_2S \dashrightarrow CaS + Na_2CO_3$ above 600° C.
2. $CaS + Na_2CO_3 \dashrightarrow CaO + Na_2S + CO_2$ above 800° C.
3. $CaO + Na_2S \dashrightarrow CaS + Na_2O$ below 800° C.

The following relationship was established at a mill trial:

$$\underset{0\%}{CaCO_3} \dashrightarrow \underset{(100-A+B)\%}{CaS} = \overset{A}{\underset{B}{=}} = \underset{(A-B)\%}{CaO}$$

In the mill trial described below, A was =64.7 and B was =44.9, i.e. CaS=80.2% and CaO=19.8%. In a laboratory experiment at 750° C., 15 minutes, 10 g smelt+1.9 g lime sludge, A=0 and B=0, was obtained with 75% of Ca as CaS.

Mill trial

At a mill trial the black liquor was premixed with lime sludge in an approximate dry solids content ratio of 15:1, (which corresponds to 20–30% of the amount of lime sludge that is produced in the process) and was supplied to the furnace cavity of the recovery boiler at normal capacity. The extensive follow-up of the analysis of the trial gave in summary the following results:

The temperature of the smelt raised by approximately 100° C., which indicates a considerable raise of the temperature in the furnace cavity.

The content of particles in the flue gases before the electrostatic precipitator was reduced by approximately 40%.

Particles' pH increased from 9.8 to 10.4 despite a decreased content of $Na_2CO_3$ in the particles.

The temperature of outgoing superheated steam raised by approximately 15° C. during the trial, and returned thereafter to a lower level.

Approximately 65% of supplied $CaCO_3$ had reacted to CaO according to the formula 1 above.

The reason for the modification of the course of combustion, which is expressed by the above observations, is not clarified, but the carbon dioxide formed at the simultaneous combustion of black liquor and processing of lime sludge (according to formula 2 above) is probably of importance for the modification.

Raised temperatures in the furnace cavity of a recovery boiler gives the following advantages for liquor combustion:

The heat recovery in the lower part of the furnace cavity is markedly improved.

The reduction of sulphur is improved.

The emission of particles with the flue gases from the level of the furnace cavity is considerably reduced (in the above example by approximately 40%).

The nature of the particles is changed to the better, which reduces the clogging of the flue gas passages in the boiler and facilitates the cleaning of the heat surfaces and reduces the consumption of soot steam.

Reduced amounts of deposits on the superheater surfaces give higher outgoing steam temperature and thus increased production of electricity.

Increased calcination in the recovery boiler.

An increase in the capacity of the liquor combustion.

Other advantages which can be obtained by conducting the processing of lime sludge in the recovery boiler is that the calcination can be done with a cheaper fuel and with lower energy consumption due to the fact that the high radiation losses that arise in a rotary kiln process are avoided. Moreover, the temperature in the furnace cavity may be regulated so that the processing of lime sludge is controlled so that increased amounts of calcium sulphide are formed in the smelt of inorganic chemicals, if this is considered to be desirable.

We claim:

1. A method of modifying the course of combustion of evaporated black liquor obtained from a sulphate pulp cooking process in a recovery boiler having a furnace cavity with an upper oxidation zone and a lower reduction zone and a gas flue, which comprises supplying evaporated black liquor and lime sludge to the furnace cavity of the recovery boiler to regulate the temperature in the furnace cavity of the recovery boiler so that the lime sludge is at least partially calcined to calcium oxide and the lime sludge gives calcium sulphide in the smelt of inorganic chemicals which is formed in the recovery boiler and wherein the black liquor and the lime sludge is premixed in an approximate dry solid content ratio of 15:1.

2. The process of claim 1 wherein the temperature of the smelt is raised by approximately 100° C.

3. The process of claim 2 wherein particles in the flue gas from the level of the furnace cavity is reduced by approximately 40%.

4. The process of claim 1 wherein the content of particles in the flue gases before contacting with an electrostatic precipitator was reduced by approximately 40%.

5. The process of claim 4 where the particles in the flue gas have a pH of about 10.4.

6. The process of claim 1 wherein approximately 65% of the supplied calcium carbonate lime sludge reacted to calcium oxide.

7. The process of claim 1 wherein flue gas particles reduce the clogging of flue gas passages in the boiler and facilitates the cleaning of heat surfaces and reduces the consumption of soot steam.

* * * * *